United States Patent [19]

Lange

[11] 4,173,171

[45] Nov. 6, 1979

[54] WORKING PROCESS OF A PNEUMATIC OPERATED RAMMING TOOL

[75] Inventor: Wilfried Lange, Altenhagen, Fed. Rep. of Germany

[73] Assignee: Firma Dieter Haubold Industrielle Nagelgerate, Hemmingen-Westerfeld, Fed. Rep. of Germany

[21] Appl. No.: 807,606

[22] Filed: Jun. 17, 1977

[30] Foreign Application Priority Data

Jul. 6, 1976 [DE] Fed. Rep. of Germany ..... 2630278

[51] Int. Cl.[2] ..... F15B 15/17; F15B 15/22

[52] U.S. Cl. ..... 91/25; 91/399; 91/416; 91/417 A

[58] Field of Search ..... 91/417 A, 399, 416, 91/25, 26, 436; 92/162 R, 162 P, 417 R

[56] References Cited

U.S. PATENT DOCUMENTS

| | | | |
|---|---|---|---|
| 3,094,043 | 6/1963 | Powers et al. | 91/416 |
| 3,351,256 | 11/1967 | Readyhough | 91/417 A |
| 3,398,648 | 8/1968 | Cairatti | 91/417 A |
| 3,651,740 | 3/1972 | Perkins | 91/417 A |
| 3,687,008 | 8/1972 | Densmore | 91/2 S |
| 3,901,130 | 8/1975 | Lange | 91/399 |

*Primary Examiner*—Paul E. Maslousky

*Attorney, Agent, or Firm*—Allison C. Collard; Thomas M. Galgano

[57] ABSTRACT

At the beginning of a working stroke of a compressed air loaded working piston disposed reciprocally in a pneumatic operated ramming tool said piston is initially set in motion under the action of minor amounts of compressed air until its top becomes immersed into stored compressed air and the working piston is then exposed to the full force of said stored compressed air to perform its working stroke. This working process permits to use a substantially simpler ramming apparatus.

7 Claims, 6 Drawing Figures

WORKING PROCESS OF A PNEUMATIC OPERATED RAMMING TOOL

The present invention relates to a working process for a pneumatic operated ramming tool having a compressed air loaded working piston disposed reciprocally therein.

It is prior known in the art for ramming apparatus of the type defined above to have compressed air enter the cylinder through inlet openings from a compressed air storage space, in order to make the piston perform its working stroke. The inlet openings can be closed by means of inlet valves which are operated by a control valve adjustable under the action of an arbitrarily operable lever. It is likewise prior known to have the compressed air flow into the cylinder via an inlet valve which is designed somewhat like a lid and/or cover.

It is a frequent practice particularly for restoring the working piston to initial position on completion of its working stroke to use compressed air which in the course of said working stroke was by the piston forced into a by-chamber of the cylinder for storage therein.

All of the prior art apparatus are however affected by the disadvantage that arrangement of the inlet valves which are often referred to as main valves also and which in most of all cases are disposed at the top extremity of the working cylinder, involves great technical complexity and very considerable expense.

It is an object of the present invention to provide a working process that permits to use a substantially simpler apparatus.

According to the invention this problem is solved in that at the beginning of a working stroke the working piston is initially set in motion under the action of minor amounts of compressed air until its top becomes immersed into stored compressed air, and that the working piston is then exposed to the full force of said stored compressed air to perform its working stroke. In the apparatus used to carry the process of the present invention into effect the working cylinder is subdivided into a pressure portion and a guide portion. Said pressure portion has its top extremity connected to the compressed air storage space via a flexible seal ring to serve as outlet and control valve, and a control port or bore which can be closed by said outlet and control valve. An annular gap between cylinder wall and piston is provided in the pressure portion area of the cylinder. Openings establishing communication with the compressed air storage space are arranged at the bottom extremity of the cylinder pressure portion. The top extremity of the working piston is fitted with two superimposed sealrings and extends into said pressure portion whereas the bottom extremity with only one sealring protrudes into the cylinder guide portion, the lower one of the two flexible sealrings disposed at the top extremity of the piston being provided to act as return stroke seal due to the fact that the diameter thereof is automatically variable. The piston ends are formed by pressure plates of which the upper plate extending into the cylinder pressure portion is greater in diameter than the lower plate protruding into the cylinder guide portion so as to ensure piston backtravel after each working stroke.

The control port or bore establishing communication between the compressed air storage space and the cylinder top extremity opens out into an internal groove of the working cylinder and is adapted to be closed off by the sealring that serves as outlet and control valve, said groove being provided with at least one bypass connecting the upper piston surface with said control bore and having a cross-sectional area that is essentially smaller than that of the control bore proper.

The inside wall of the working cylinder is provided with another annular groove in level with the return stroke seal when the working piston is in rest position. In the area of the openings establishing communication with the compressed air storage space the diameter of the cylinder pressure portion is adapted to the nominal diameter of the return stroke seal and vice versa while the diameter of the top cylinder pressure portion conforms to the maximum value of the variable diameter of the return stroke seal. Said different cylinder diameters are interconnected via transition bevel. The outlet opening for the compressed air volume to be discharged during the return stroke is formed by an annular gap between said outlet and control valve and a central lug portion which closes the cylinder off on top. The outlet cross-section can be shut by a radial constriction of the outlet and control valve.

For initially pushing the piston until its top surface plunges into the compressed air that is present in the cylinder pressure portion there if only a very little amount of air required. Immediately after this initial pushing operation the compressed air volume can fully impinge the entire piston top from all sides so that the working stroke may be performed with full power right from the start. Percussions and/or ramming action can take place in direct succession without any time being needed between the various working strokes to build up an air cushion in a by-chamber for piston backtravel.

The apparatus required to carry the working process of the present invention into effect is not fitted with any mechanical type of main inlet valve in the form of lifting and/or sliding components which is an essential contribution to cost saving. Since the outlet and/or control valve will be closed before control air flows through the control port and into the cylinder for initial pushing of the piston, there are no leakage losses involved due to compressed air escaping into the free atmosphere. Besides saving costs, omission of a mechanically movable main inlet valve simultaneously reduces the weight of the assembly, and a further reduction in weight is obtained by omission of a by-chamber to store compressed air for working piston backtravel. The user or operator of this apparatus may use commercial type standard sealrings to replace defective rings if so required. There are no cross-sections that would obstruct the ingress of compressed air to impinge the piston top so that a high ramming performance is obtained. Apat from the inevitable moving piston the apparatus includes just one more mechanically movable component, namely the release rod which is operable via a trigger lever.

Since there is no by-chamber that in prior art devices of this type would be needed to store compressed air for initiation of piston backtravel, the compressed air is better utilized since the considerable amount of compressed air needed for piston backtravel hitherto need not be stored any more. The extremely small volume of air required for initial pushing of the piston is by far less than the amount of air conventionally needed to move a main valve. Since the outlet and control valve will not open the outlet cross-section to the free atmosphere until the return stroke seal—that is the lower one of the two sealrings disposed at the piston top—has closed or sealed off the cross-sectional areas for compressed air feed from the compressed air storage space into the cylinder, that portion of the air only is discharged into the free atmosphere which is necessary to perform one working stroke. This results in a compressed air saving of about 40 to 50% as compared with the conventional tools which are fitted with a main inlet valve and provided with a by-chamber to effect piston backtravel. This means considerable energy savings in larger-scale plants where a large number of tools would be used and operated simultaneously.

Further features of the present invention will be evident from an exemplified embodiment which is schematically represented in the accompanying drawings and which shall now be described in closer details.

Figure 1:
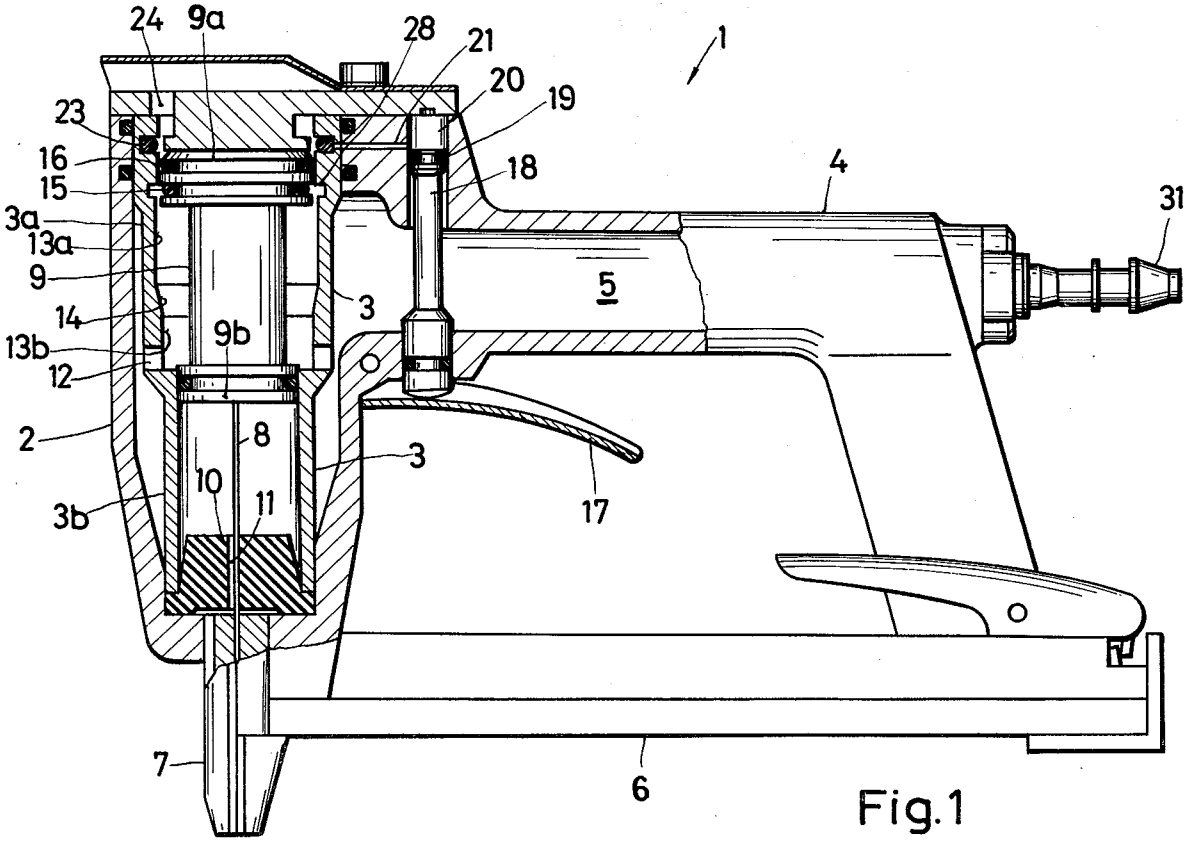
FIG. 1 is a general elevation of the tool according to the present invention which is partly shown in section.

The apparatus or tool 1 comprises a casing 2 to accommodate the working cylinder 3, and a handle 4 with compressed air storage space 5 disposed therein. The storage magazine 6 for fastening elements such as staples, nails and the like has its forward extremity closed off by a muzzle member 7 whose guide port affords guiding action to a ram rod 8 forming part of the working piston 9. The working cylinder 3 comprises a top compressed air portion **3*a* and a bottom compressed air portion 3*b* inwardly offset from said top portion 3*a* to guide the bottom end 9*b* of the piston while the top end 9*a* of the stepped piston 9 is adapted to slide along the compressed air portion 3*a* of said cylinder 3. The cylinder 3 rests by its bottom end on a resilient buffer 10 which at the same time serves to resiliently brake down the working piston as it reaches its end position. The buffer 10 is provided with a compensating aperture 11 for air displaced in the course of the working stroke to escape through and/or for ambient air during the return stroke to enter through. Connecting apertures 12 are provided to fill up the top portion of the cylinder 3 with compressed air from the compressed air storage space 5. While the bottom portion of cylinder 3 is of constant diameter, the top portion 3*a* has a plurality of different inside diameters which are designated by reference numerals 13*a* and 13*b*. A transition bevel 14 provides a gradual transition which the lower one of the two seals disposed on the upper extremity 9*a* of the piston is able to follow. This seal is provided as return stroke seal 15. The seal thereabove, i.e., seal 16, solely serves to seal off the top portion of the working cylinder to thereby prevent compressed air flow from the compressed air portion 3*a*** of the cylinder out of the unit.

A release rod 18 can be operated by a trigger lever 17, said release rod having its upper end provided with a seal 19 and extending into a port 20. Depending on the position of said trigger lever 17, therefore, the control port 21 will be connected to and/or disconnected from the compressed air storage space 5. The control port 21 opens out into a groove 22 at the cylinder top end and is sealed by means of a gasket 23 which serves a dual function: This gasket serves as outlet and control valve since its diameter is variable as a function of compressed air application. The aperture establishing communication with the ambient atmosphere is designated by the reference numeral 24. It is by a concentric lug member 25 extending into the top portion of the cylinder that a gap 26 is formed for compressed air escaping into the free atmosphere. This gap can be sealed off by said gasket 23. Groove 22 is fitted with at least one bypass 27 which connects the piston top to the control port 21 as the outlet and control valve 23 becomes seated against said concentric lug member 25. Underneath the annular groove 22 there is another annular groove 28 of cylinder 3 disposed in level of the return stroke seal 15 when the piston 9 is in starting position. Seal rings 29 and 30 retain the working cylinder 3 inside the working tool in conventional manner. Compressed air can be supplied to the apparatus through a connecting socket 31.

Figure 2:
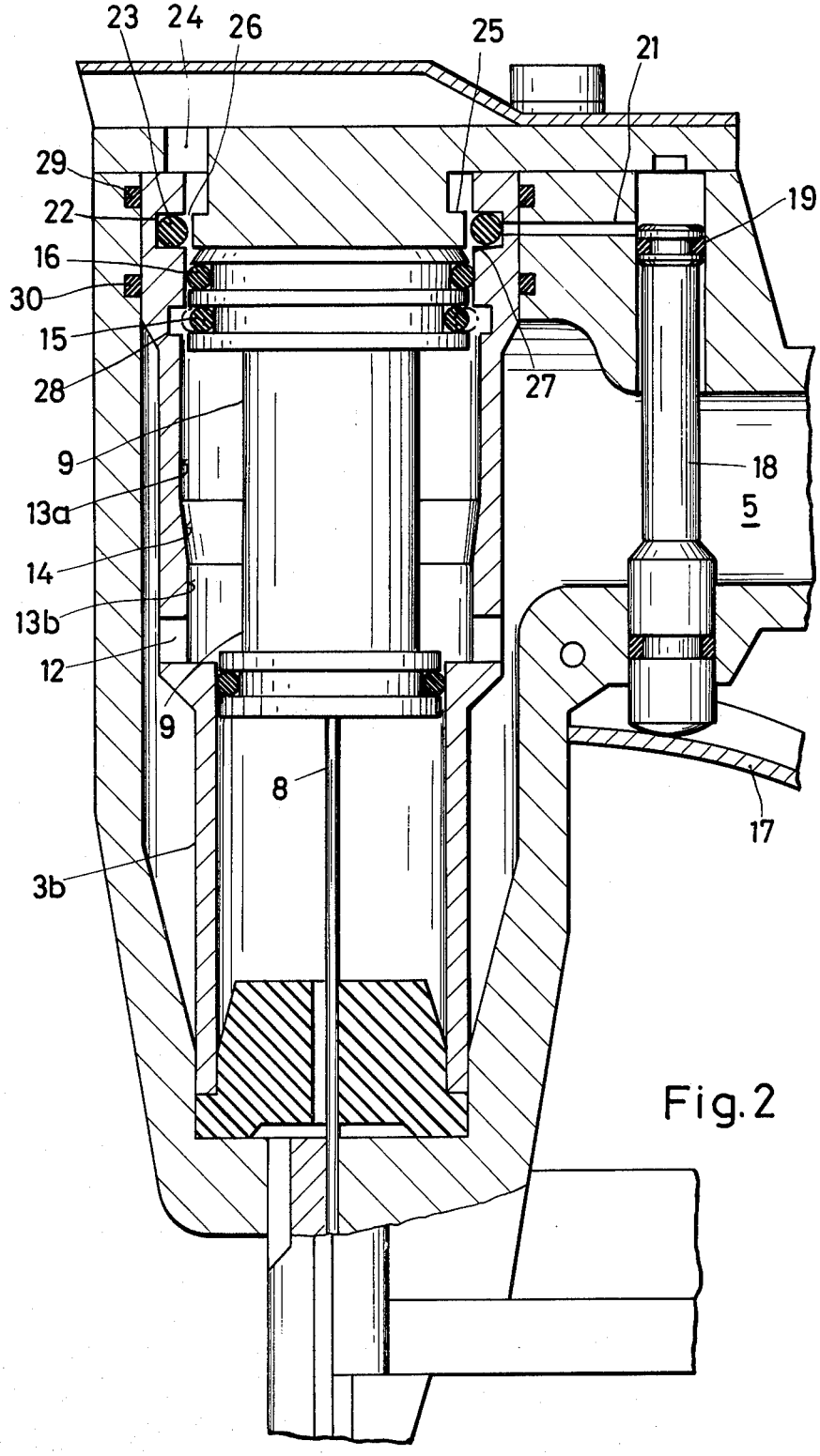
FIG. 2 is a section of the working piston area of the tool according to FIG. 1 which shows the working piston in rest position.
Figure 3:
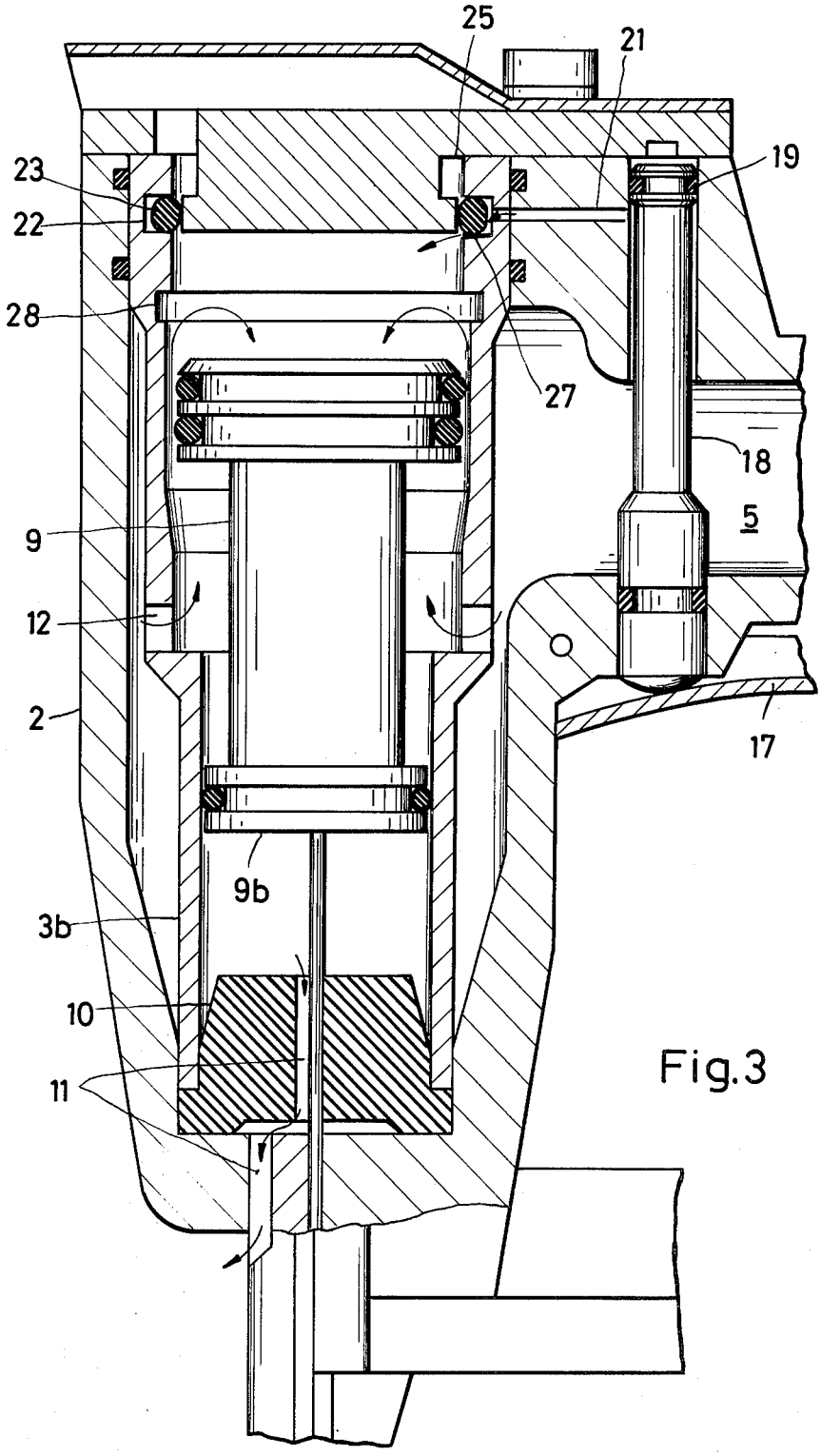
FIG. 3 shows the assembly according to FIG. 2 whose working piston is about to commence its working stroke.

While in rest position as shown in FIG. 2 the working piston 9 is in its top extreme position, with the trigger lever 17 being in bottom extreme position so that the release rod 18 by its seal 19 closes off the control port 21 against the compressed air storage space 5.

The internal opening of control port 21 is closed by the outlet and control valve gasket. Gap 26 is open to connect the piston top to the free atmosphere via outlet bore or port 24. The return stroke seal 15 of the piston 9 which (seal) faces groove 28 is in contact with the seal which means that the gasket has its nominal diameter. The piston groove in which the seal 15 is received is greater than the cross-section of the seal ring so that radial expansion thereof is no problem. This requires, however, that the piston groove receiving said seal 15 be dimensioned so that there is a gap between the seal and the groove walls which (gap) permits compressed air to flow behind the seal ring.

Following actuation of the trigger lever 17 the release rod 18 is pushed upward so as to cause the seal 19 to open control port 21 and to thereby permit compressed air to enter thereinto from the compressed air storage space 5 of the tool. Compressed air present in port 21 forces the gasket 23 which constitutes the outlet and control valve against the concentric lug member 25 and interrupts the communication between the cylinder interior and the free atmosphere. The gasket 23 is then deformed so that the compressed air entering through the control port 21 is allowed to flow into the cylinder cavity through the bypass opening 27 only. Said bypass opening (or openings) has so small a cross-section as compared with that of control port 21 that the pressure prevailing therein cannot reduce, but keeps on forcing the gasket 23 against the lug member 25. The small compressed air volume entering through the bypass 27 is sufficient for initially pushing the piston 9 until its top gets to within range of groove 28. Due to the sudden increase in diameter the upper piston end, i.e., the seal assembly 15/16, is no longer in contact with the cylinder walls. This implies that compressed air entered from the compressed air storage space 5 through the connecting apertures 12 can flow past the piston sides and act on the piston top. The piston acts as disk piston during its working stroke and as stepped piston only during its return stroke.

While performing its working stroke the bottom portion **9*b* of the piston is guided in the guide portion 3*b* of the cylinder 3. The air present underneath piston 9*b* is displaced outward through opening 11 in the buffer 10 and/or the casing 2** so that in the course of the return stroke air flows upward into the lower portion of the cylinder so that no underpressure condition can develop therein.

Figure 4:
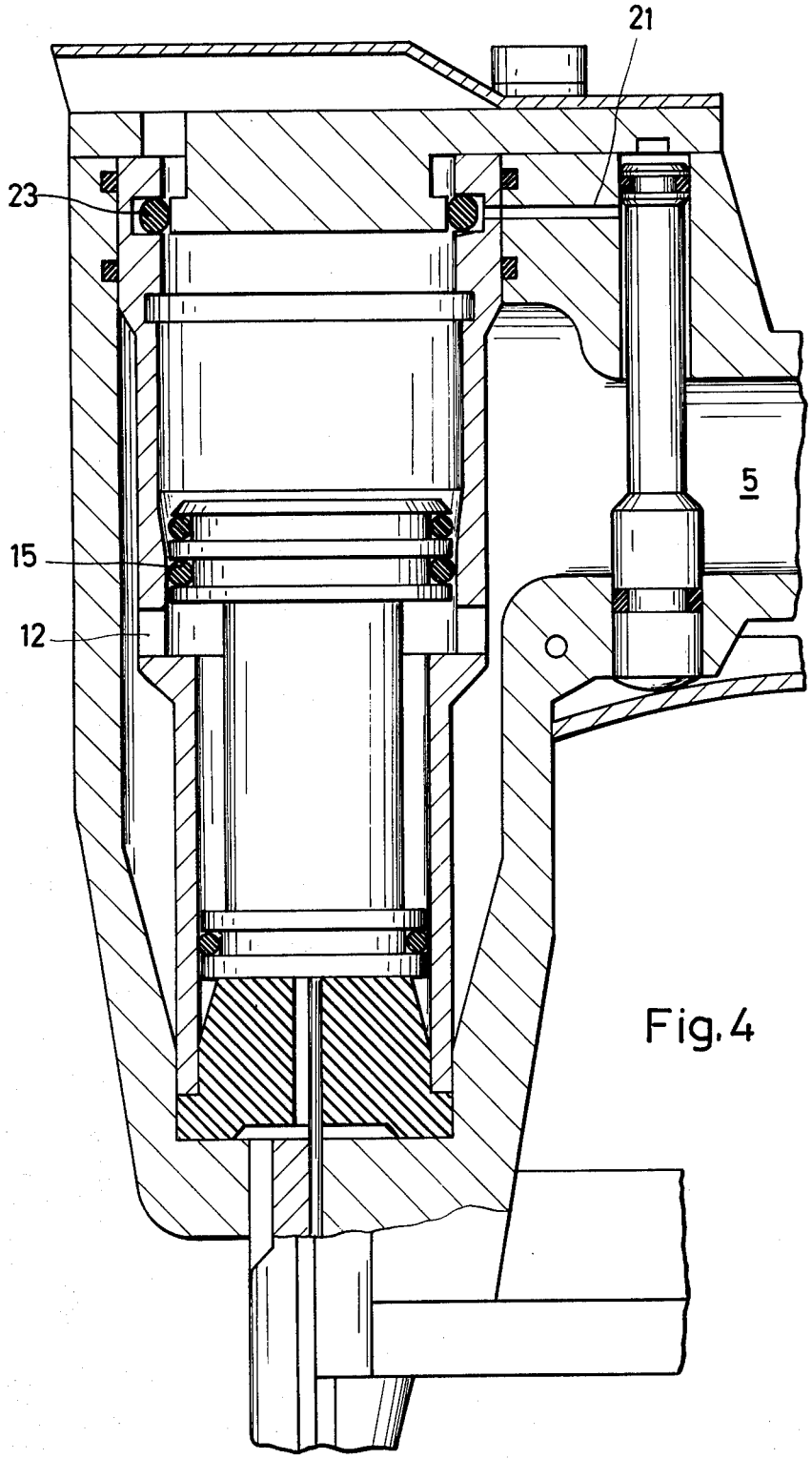
FIG. 4 represents the working piston on completion of its working stroke.
Figure 5:
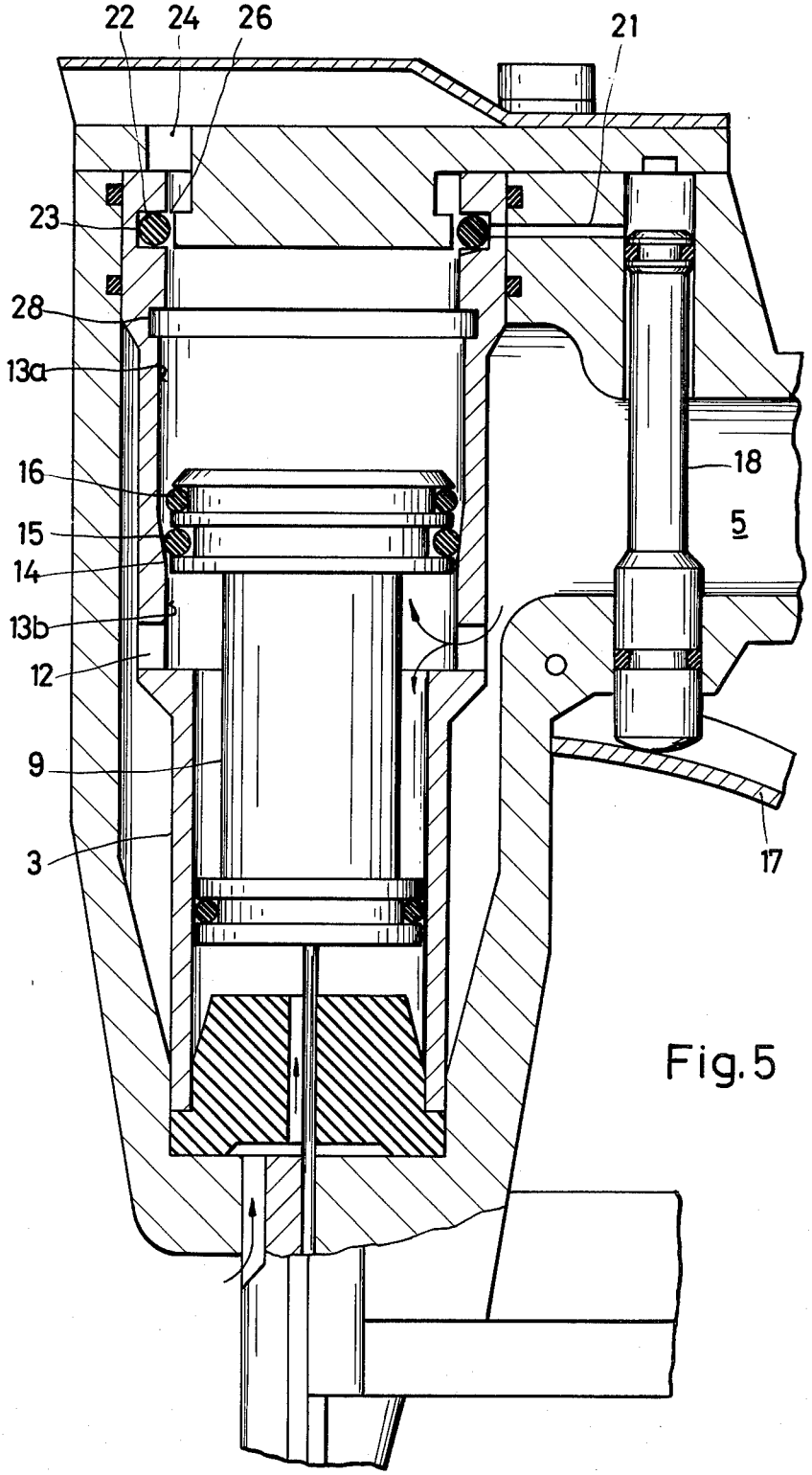
FIG. 5 shows the piston on commencement of its return stroke.
Figure 6:
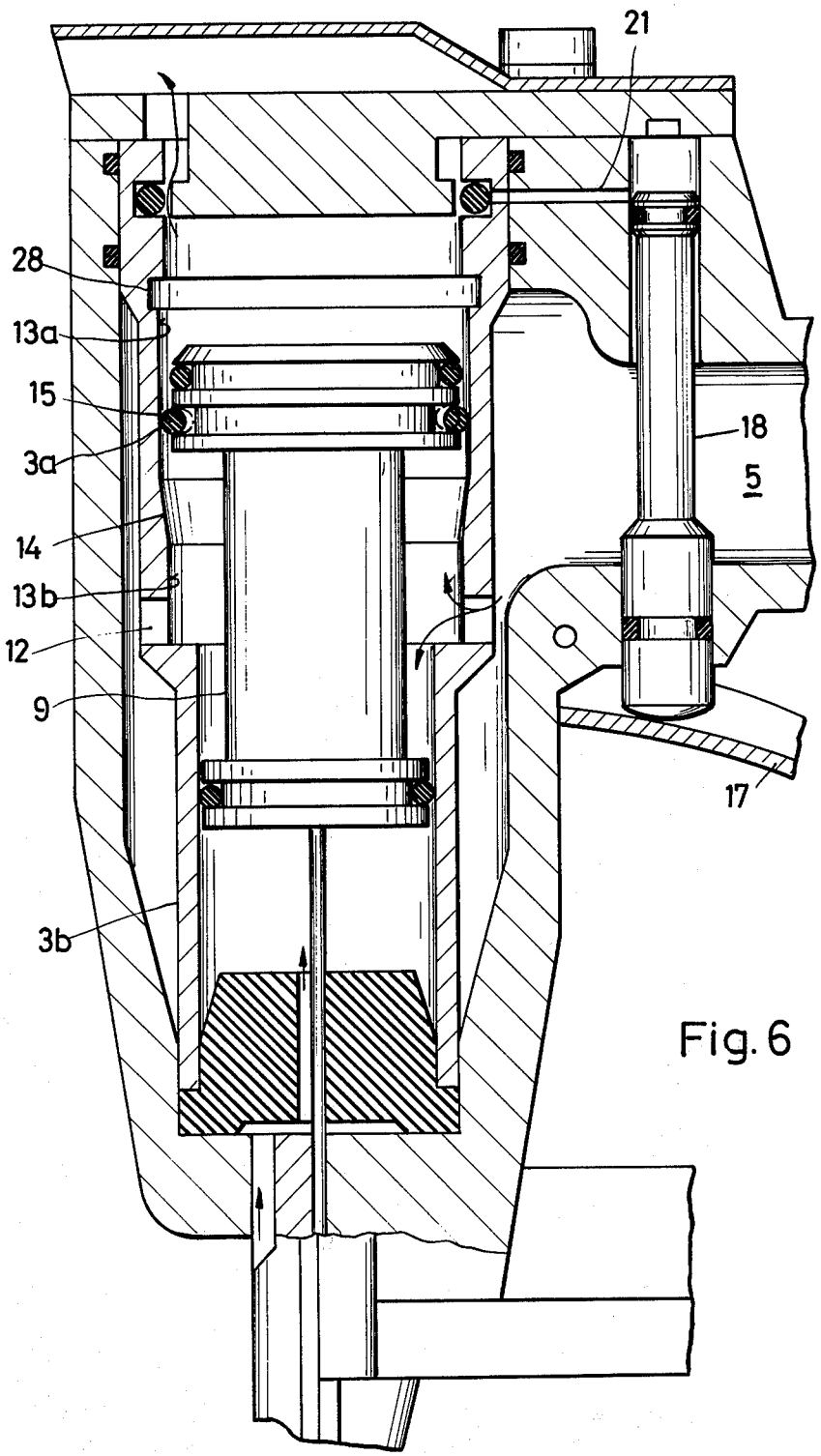
FIG. 6 is a representation of the working piston in a progressed stage of its return stroke.

As soon as the working piston 9 has descended to such an extent as shown in FIG. 4 that the return stroke seal 15 again contacts the inside wall of the working cylinder, the compressed air entering through openings 12 is prevented from flowing on to the piston top. The seal of the outlet and control valve 23 is retained against its inner seat until the end of the working stroke since pressure is still present via the control port 21 from the compressed air storage space 5. Only on releasing the trigger lever 17 and reversal of the release rod 18 is the compressed air from the compressed air storage space 5 prevented from passing on to the control port 21. The compressed air till that moment present in the working cylinder above piston 9 and the flexibility of the seal then force the gasket 23 against its radial outer seat in groove 22 and hence against the mouth of control port 21. This clears the way from the cylinder 3 through annular gap 26 and outlet openings 24 to the ambient air. Compressed air entering through the openings 12 of cylinder 3 can push piston 9 up again since the force created by the pressures acting on the piston surfaces is directed upward. As the return stroke seal 15 leaves the area **13*b* of cylinder 3 and enters the transition bevel 14 to area 13*a* of the cylinder, it is radially expanded into sealing contact with the cylinder inside wall until it reaches the groove 28 (FIGS. 5 and 6). Said radial expansion of the return stroke seal 15 is accomplished under the action of compressed air that passes through the annular gap between cylinder wall and piston periphery and slightly lifts the seal loosely seated in the piston annular groove, and that then flows through the open gap to the inside face of the seal. This results in a radially outward directed force component which expands the return stroke seal 15 to such an extent that it is sealingly engaged with the inner cylinder wall also within cylinder area 13*a*. For better comprehension of this control process, said seal ring inner seat or contact position is shown in dashlines at the bottom of the piston annular groove in FIG. 6**.

As soon as the return stroke seal 15 gets to within range of the cylinder groove 28, compressed air is allowed to flow past its outside and act on its outside face so that owing to its flexibility it takes its nominal diameter and hence its seat in the piston groove bottom. This is the moment when the piston 9 reaches its top end position and the tool is ready for operation again.

What is claimed is:

1. In a pneumatically-operated ramming tool, the combination comprising:

a compressed air storage chamber;

a hollow, working cylinder having internal walls which define a generally cylindrical, internal cavity, comprising an upper pressure portion having an upper end and a lower end and a lower guide portion, the upper end of said pressure portion having a closable control port and the lower end of said pressure portion having a plurality of connecting apertures, both of which establish communication with said compressed air storage chamber; and a piston slidably received within said cavity of said cylinder for reciprocable movement between an upper rest position and a lower work position, said piston having a top end which is reciprocably movable only within the pressure portion of said cylinder and which carries two vertically, spaced-apart, flexible seal rings, with the lower one of said two seal rings having a variable diameter, so as to serve as a return stroke seal, a bottom end which is reciprocably movable only within the guide portion of said cylinder and which carries a flexible seal ring, and an intermediate portion joining said top and bottom ends thereof, and defining an annular gap between said piston and said cylinder walls.

2. The tool according to claim 1, wherein said piston includes two, disc-shaped, pressure plates, which form said piston ends, with the pressure plate forming the top end having a greater diameter than the plate forming the bottom end.

3. The tool according to claim 1, wherein the cylinder wall defining said upper end of said pressure portion has a first annular groove formed therein, onto which said control port opens, wherein said tool additionally includes a gasket disposed in said groove, which serves as an outlet and control valve for said port, and wherein said groove is provided with at least one bypass, establishing communication between said compressed air storage chamber and said top end of said piston, said bypass having a cross-sectional area smaller than that of said control port.

4. The tool according to claim 3, wherein the cylinder walls defining the upper end of said pressure portion has a second annular groove formed therein, disposed opposite said return stroke seal, when said piston is at its upper rest position, and wherein said lower end of said pressure portion has a diameter corresponding to the nominal diameter of the return stroke seal, while the diameter of said upper end of said pressure portion has a diameter which corresponds to the maximum value of the variable diameter of said return stroke seal.

5. The tool according to claim 4, wherein the cylinder walls defining said upper and lower ends of said pressure portion merge together by means of a transition bevel.

6. The tool according to claim 3 additionally including a disc-shaped lug portion, disposed concentrically in said cylinder cavity, inwardly of said gasket, which serves as a valve seat for said gasket, so as to prevent compressed air from escaping into the free atmosphere during movement of said piston from its rest position to its work position.

7. The tool according to claim 4, wherein said second annular groove is slightly larger in size than the cross-section of said return stroke seal.

* * * * *